US008205295B2

(12) United States Patent
Howie et al.

(10) Patent No.: US 8,205,295 B2
(45) Date of Patent: Jun. 26, 2012

(54) WATER BASIN ILLUMINATION

(75) Inventors: Mark Howie, Cadillac, MI (US); Jeffrey R. Kassien, Tustin, MI (US); Alan Belville, LeRoy, MI (US)

(73) Assignee: Rexair, LLC, Troy, MI (US)

( * ) Notice: Subject to any disclaimer, the term of this patent is extended or adjusted under 35 U.S.C. 154(b) by 430 days.

(21) Appl. No.: 12/501,115

(22) Filed: Jul. 10, 2009

(65) Prior Publication Data

US 2011/0005026 A1 Jan. 13, 2011

(51) Int. Cl.
*A47L 9/00* (2006.01)

(52) U.S. Cl. ..... 15/339; 15/347

(58) Field of Classification Search ..... 15/324, 15/339, 347; *A47L 9/00*
See application file for complete search history.

(56) References Cited

FOREIGN PATENT DOCUMENTS

| | | | |
|---|---|---|---|
| EP | 1 308 176 | A2 | 5/2003 |
| EP | 1 452 120 | A1 | 9/2004 |
| EP | 1 695 648 | A2 | 8/2006 |
| GB | 2 441 174 | A | 2/2008 |
| JP | 2008 023133 | A | 2/2008 |

OTHER PUBLICATIONS

PCT International Search Report for PCT/US2010/025141 dated Oct. 18, 2010.

*Primary Examiner* — David Redding
(74) *Attorney, Agent, or Firm* — Rader, Fishman & Grauer, PLLC

(57) ABSTRACT

A vacuum cleaner assembly is disclosed. The vacuum cleaner assembly includes a housing assembly having a motor connected to a vacuum source, a particulate collection pan interconnected to the housing and a base and an illumination source for illuminating the particulate collection pan.

12 Claims, 5 Drawing Sheets

WATER BASIN ILLUMINATION

BACKGROUND

Vacuum cleaners of various designs are used in residential and commercial applications for cleaning. These vacuum cleaners create a suction airflow that picks up dirt and dust particulates from a surface in need of cleaning. The vacuum cleaner separates these particulates from an ingested air for later disposal.

One type of vacuum cleaner design is a water filtration vacuum cleaner, which includes a canister style vacuum cleaner with a water bath. Such vacuum cleaners use water as a filter. These vacuum cleaners typically include a main housing with a removably attached water bath pan. In operation, these vacuum cleaners force the intake air and ingested particulates to pass through a water bath, which absorbs most of the particulates before the air is exhausted to the environment. While the water filters out debris that is water soluble; this debris may harbor unseen bacteria that may be harmful if exhausted in airborne particulates. Once the water has absorbed the particulates, the operator is required to dump the water basin and rinse the machine. However, it is difficult for the operator to see the cleanliness of the water to determine when the water should be discarded, which can cause the further breeding of bacteria.

Ultraviolet (UV) radiation can be an effective viricide and bactericide and is somewhat effective in treating microorganisms such as cryptosporidium. Therefore, a need exists for a device that provides clear examination to determine when to dispose of a soiled water bath while enhancing a potential for killing bacterium. Particularly, a need exists for a light source providing illumination of the vacuum cleaner canister as well as potentially killing any bacterium existing in a particulate canister.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are not intended to be exhaustive or otherwise limit or restrict the claims to the precise forms and configurations shown in the drawings and disclosed in the following detailed description.

DETAILED DESCRIPTION OF THE INVENTION

Figure 1:
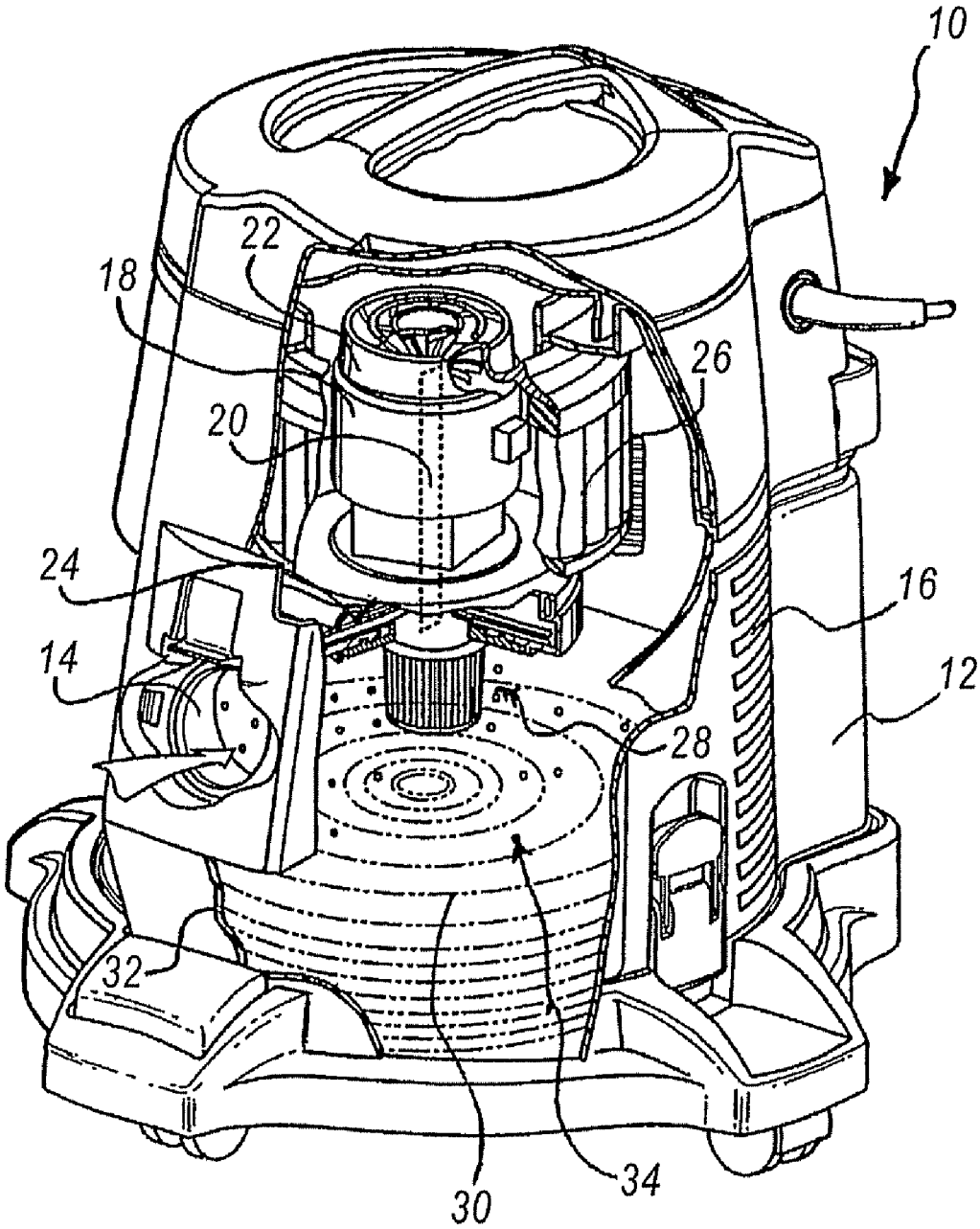
FIG. 1 is a perspective view of a vacuum cleaner assembly, partially broken away and in cross section.

Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

Referring to the Figures, wherein like numerals indicate like or corresponding parts throughout the several views a vacuum cleaner assembly is generally shown at 10. The vacuum cleaner assembly 10 comprises a housing 12 having internal area and an external surface. The housing 12 includes a flow path having an intake port 14 and an outlet 16. A motor 18 is disposed within the internal area of the housing 12 between the intake port 14 and the outlet 16. The motor 18 includes an output shaft 20 for rotating about an axis.

The assembly 10 also includes a cooling fan 22, mounted within the housing 12 above the motor 18 and coupled to the output shaft 20 for generating a vacuum airflow through the intake port 14 in the housing 12. The cooling fan 22 circulates cooling air around the motor 18. The assembly 10 further comprises a cooling air filter 26 surrounding the motor 18 wherein the cooling air filter 26 directs the cooling air around the motor 18 and filters the cooling air prior to being exhausted.

A fan assembly 24 is mounted within the housing 12 below the motor 18. The fan assembly 24 provides for drawing air into the intake port 14 and exhausting air outwardly through the outlet 16.

A separator, generally shown at 28, may be coupled to the output shaft 20 to separate dust and dirt particulates. In such an arrangement, the separator 28 is mounted below the fan assembly 24 and is designed to circulate the air and a water bath 30 within a water bath pan 32. The water bath pan 32 is also considered to be a particulate canister. A combination of the water bath pan 32 and the water bath 30 is used as a primary filter for filtering particulates, generally indicated at 34, from the air prior to exhausting the air outwardly through the outlet 16.

Figure 2:
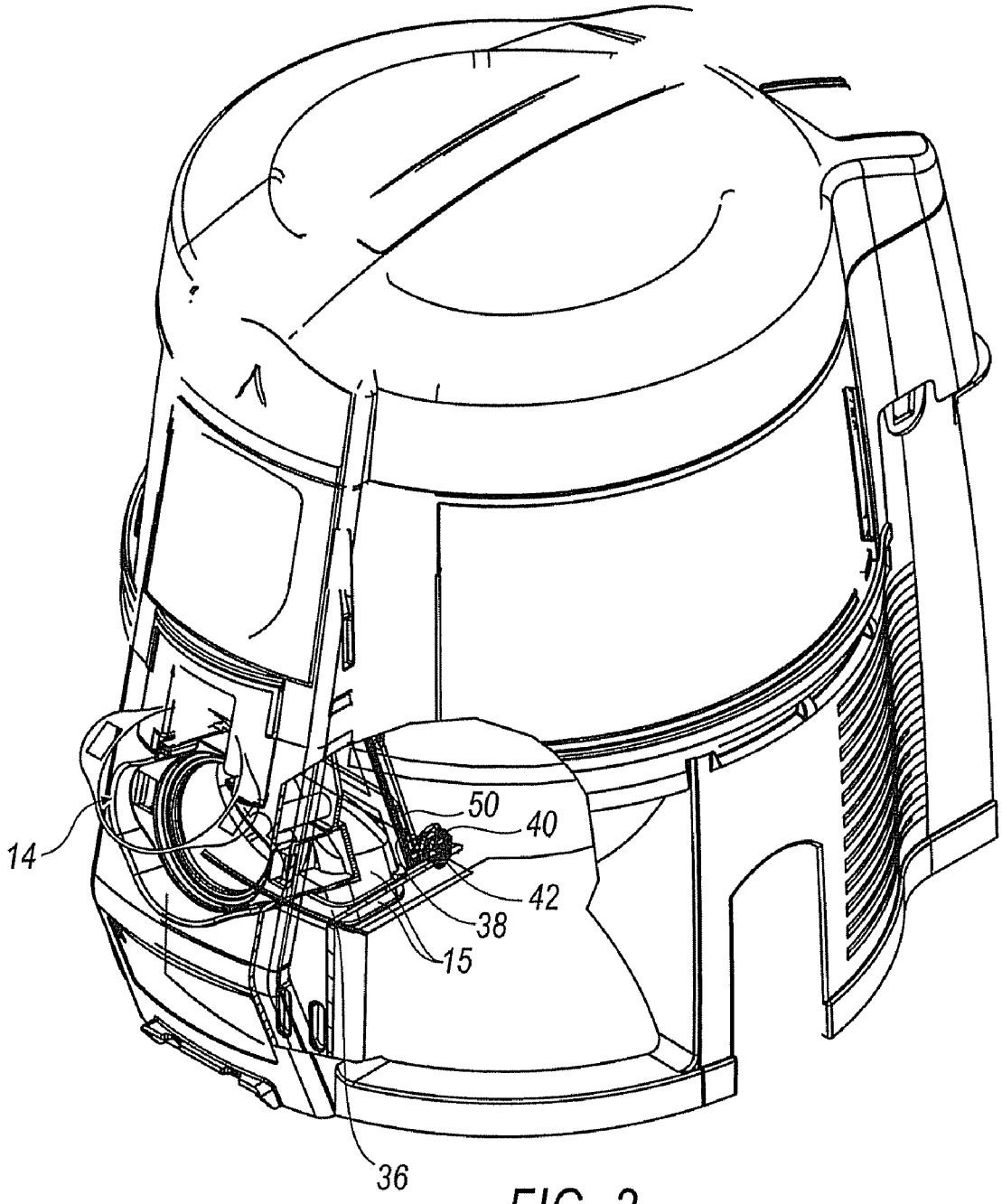
FIG. 2 is a perspective view of the vacuum cleaner housing of FIG. 1, partially broken away and in cross section illustrating an intake port and lighting position.
Figure 3:
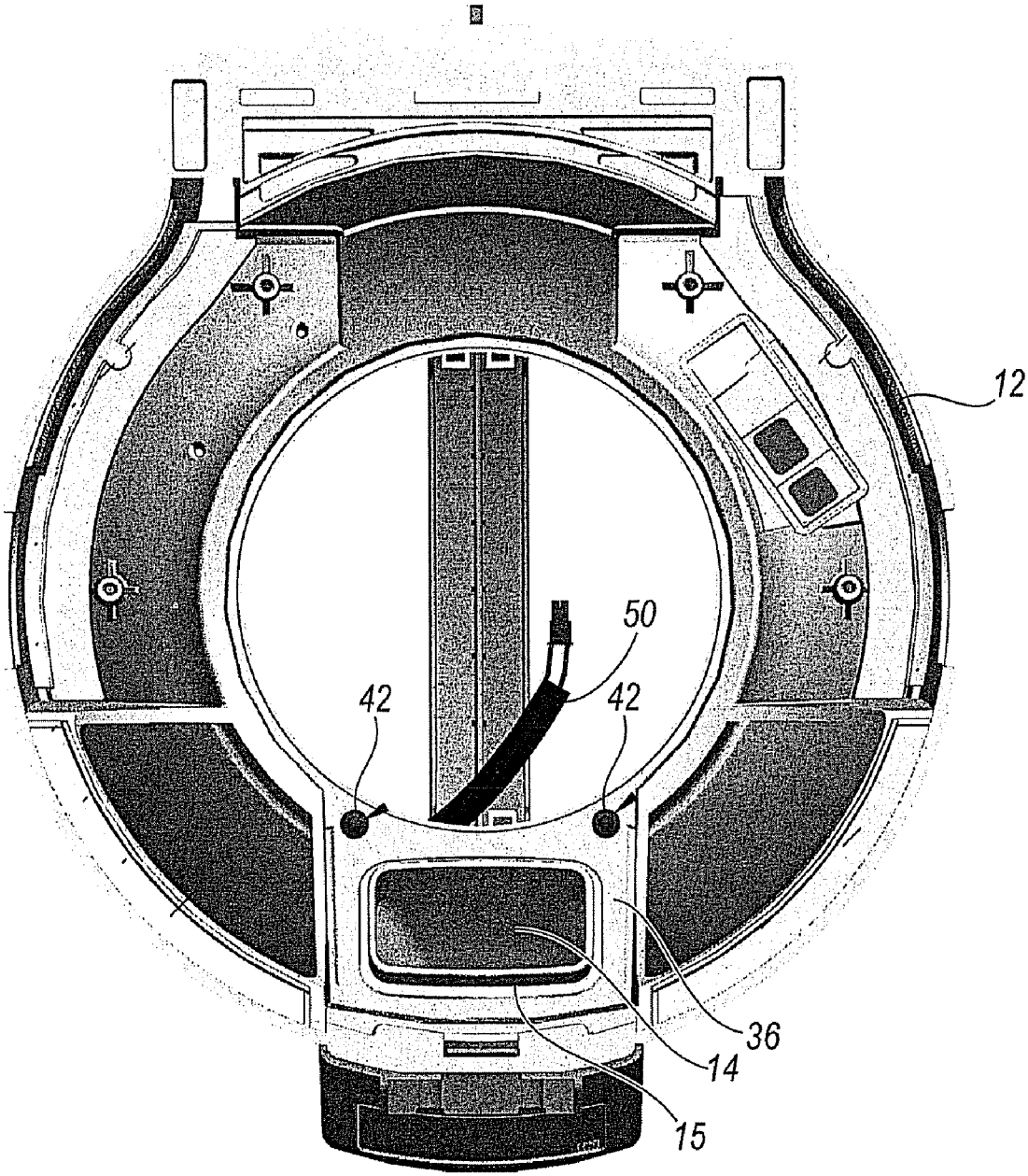
FIG. 3 is a bottom plan view of the vacuum cleaner housing of FIG. 1, illustrating the lighting position relative to the intake port and a wiring connection.
Figure 4:
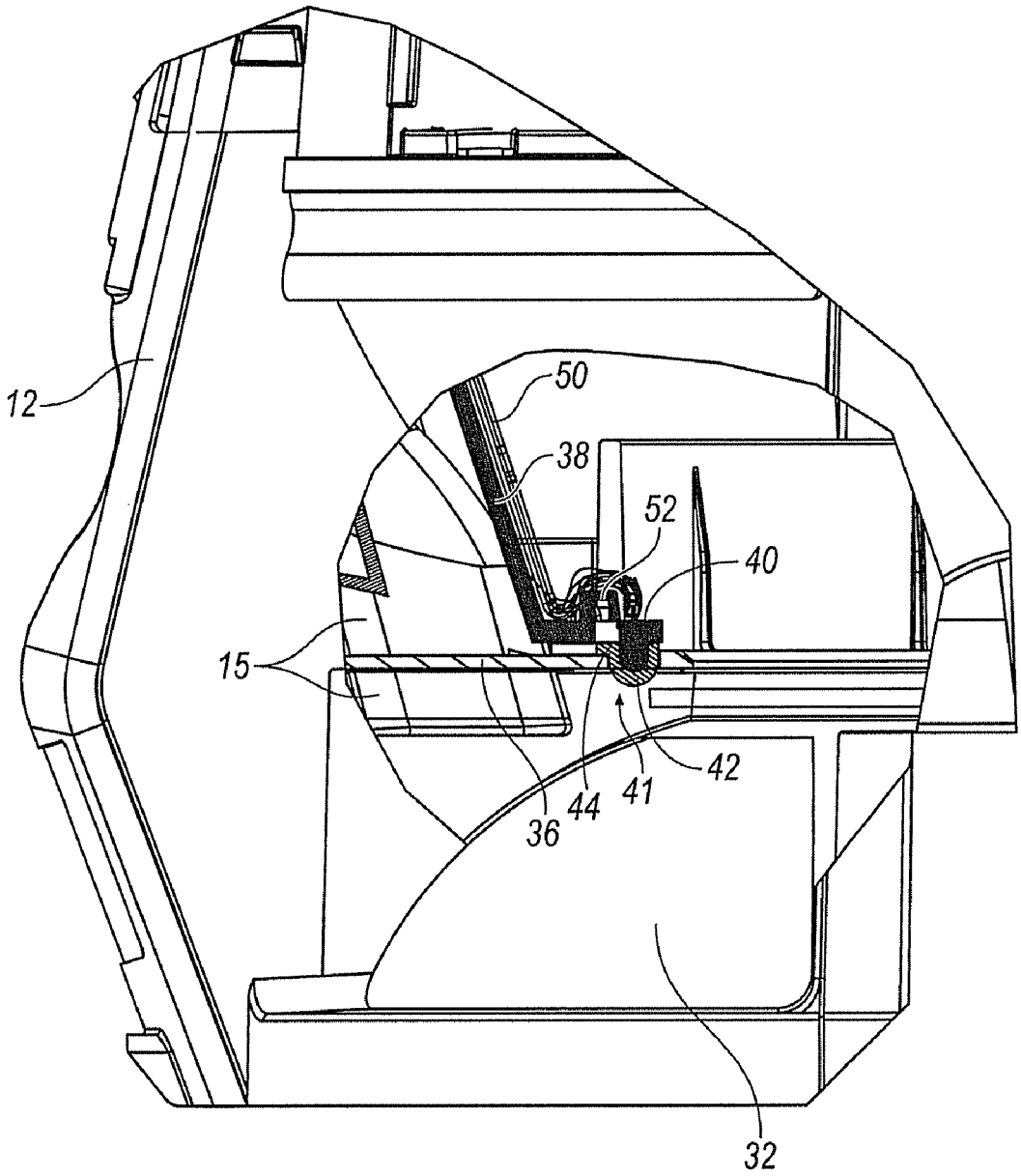
FIG. 4 is a partial side view of the vacuum cleaner housing, partially broken away and in cross section illustrating a lighting mount and a wiring position.
Figure 5:
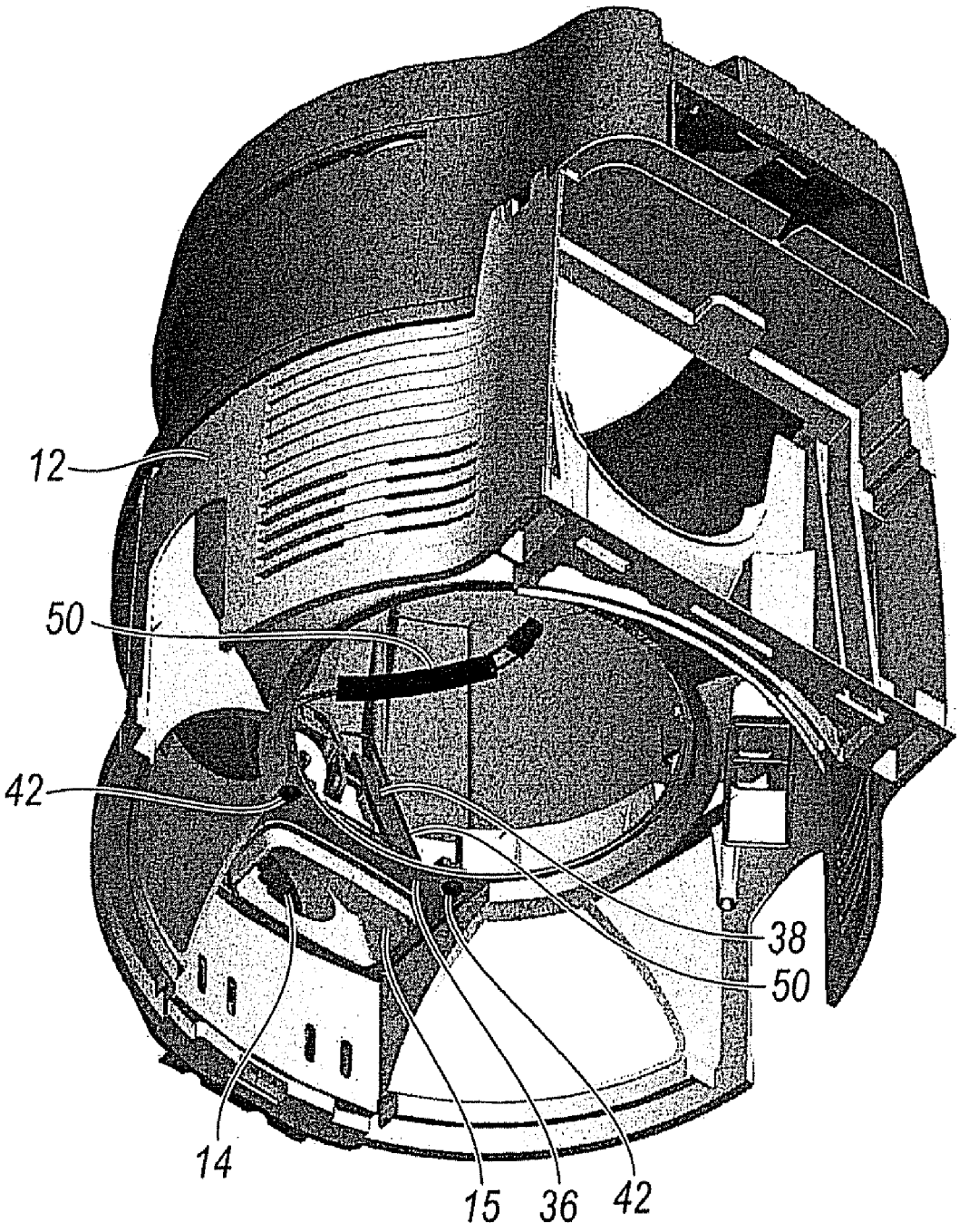
FIG. 5 is an isometric view of the bottom of the vacuum cleaner housing.

As shown in FIGS. 2 and 3, a mounting member 36 is provided. The mounting member 36 provides a mechanism for mounting and supporting the intake port tubing 15 as well as a surface for mounting a light source 40 above the water bath pan 32. The mounting surface 36 is shown as generally planar but could be a surface of any shape or contour capable of attaching the intake port tubing 15 and the light source 40. Further, while shown as a one-piece mounting surface 36, it is understood that mounting surface 36 may be constructed of multiple pieces. As shown in FIGS. 4 and 5, in one exemplary arrangement, the intake port tubing 15 extends through the mounting surface 36.

The mounting surface 36 may include a notch or an aperture 41 (FIGS. 4 and 5) that is capable of receiving either a light source 40 or light bulb housings 42 for receiving the light source 40. The bulb housings 42 provide a barrier between the water bath pan 32 and the light source 40. The bulb housings 42 are generally translucent allowing the light source 40 to penetrate into the water bath pan 32. It is noted that while the light source 40 has been shown as being mounted to the mounting surface 36, light source 40 may be mounted on any surface within the housing 12 that is capable of supporting the light source 40 as it projects light into the water bath pan 32.

The light source 40 includes a wiring harness 50 that is connected to a receptacle (not shown) on a power source (not shown) within the housing 12. The power source is energized when the operator attaches the vacuum cleaner assembly 10 to a conventional electrical outlet within the operator's work area. The power source also provides power to the motor 18 creating rotation which, in turn, creates the vacuum within the assembly 10.

The light bulb housing 42 includes a mounting lip 44, which provides a positive stop keeping the light bulb housing 42 from falling through when inserted into the aperture or notch 41 of the mounting surface 36. The light bulb housing 42 also provides a protective shell from water and anything else that may damage the light source 40.

In one exemplary arrangement, the light source 40 is inserted into the light bulb housing 42 and is retained by a locking mechanism 38. However, the light source 40 may also be inserted and retained by a press fit between the light source 40 exterior surface and the light bulb housing 42 interior surface. As illustrated, the locking mechanism has a lip 52 that engages the top surface of the light source 40 and is held in place by a snap fit mechanical latching system. The locking mechanism 38 may also be held in place by any type of known mechanical latching system such as screws, snap-fit, press-fit, latches or adhered by adhesives. The locking mechanism 38 also provides a guide for attaching the wiring harness 50 keeping the wiring harness 50 away from spinning components such as the motor 18 and the separator 28.

The light source 40 may be one of any known illumination device including, but not limited to, light emitting diodes (LEDs), incandescent bulbs, ultraviolet or florescent lights. The light source 40 provides multiple functions, including illumination of the water bath 30 demonstrating that the vacuum is functioning properly on the vacuum assembly 10. The illumination of the water bath 30 allows serves as an indicator to visually indicate to an operator when the assembly 10 is pulling vacuum, as well as when the water bath 30 has become saturated with particulates 34, requiring the water bath pan 32 to be emptied. When using the ultra-violet light source 40 the operator will be able to potentially kill any bacterium that is present within the particulate in the water bath 30 thus preventing the bacterium and particulate from reentering the atmosphere through the vacuum exhaust outlet 16.

The appended claims have been particularly shown and described with reference to the foregoing embodiments, which are merely illustrative of the best modes for carrying out the invention defined by the appended claims. It should be understood by those skilled in the art that various alternatives to the embodiments described herein may be employed in practicing the invention defined by the appended claims without departing from the spirit and scope of the invention as defined in claims. The embodiments should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

With regard to the processes, methods, heuristics, etc. described herein, it should be understood that although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes described herein are provided for illustrating certain embodiments and should in no way be construed to limit the appended claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A vacuum cleaner assembly, comprising:
a housing assembly having an inlet port and an outlet port;
a motor;
a vacuum source for drawing particulates into the housing assembly;
a particulate collection pan positioned within the housing;
a separator operatively attached to the motor below the vacuum source; and
at least one light illumination source arranged so as to illuminate the particulate collection pan.

2. An assembly as set forth in claim 1, further comprising a light illumination source locking mechanism secured to a portion of the housing.

3. An assembly as set forth in claim 1, further comprising a mounting member.

4. An assembly as set forth in claim 3, wherein the mounting member includes at least one illumination source housing.

5. An assembly as set forth in claim 1, wherein said the light illumination source is an ultra-violet light.

6. An assembly as set forth in claim 1, wherein the said light illumination source is an incandescent light.

7. An assembly as set forth in claim 1, wherein the said light illumination source is a light emitting diode.

8. A vacuum cleaner assembly, comprising:
a housing;
a motor;
a fan assembly operatively connected to said motor;
a separator positioned below the fan assembly and operatively connected to the motor;
a base;
a particulate canister; and
at least one canister illumination device.

9. An assembly as set forth in claim 8, further comprising a sealable illumination device housing.

10. An assembly as set forth in claim 8, wherein the canister illumination device illuminates said particulate canister with an ultra-violet light.

11. An assembly as set forth in claim 8, wherein the canister illumination device illuminates said particulate canister with an incandescent light.

12. An assembly as set forth in claim 8, wherein the canister illumination device illuminates said particulate canister with a light emitting diode.

* * * * *

UNITED STATES PATENT AND TRADEMARK OFFICE

CERTIFICATE OF CORRECTION

PATENT NO. : 8,205,295 B2
APPLICATION NO. : 12/501115
DATED : June 26, 2012
INVENTOR(S) : Mark Howie et al.

It is certified that error appears in the above-identified patent and that said Letters Patent is hereby corrected as shown below:

At column 4, claim number 5, line number 39, immediately following "wherein", please delete "~~said~~".

At column 4, claim number 6, line number 41, immediately following "the", please delete "~~said~~".

At column 4, claim number 7, line number 43, immediately following "the", please delete "~~said~~".

Signed and Sealed this
Fourteenth Day of August, 2012

David J. Kappos

David J. Kappos
*Director of the United States Patent and Trademark Office*